US007366454B2

(12) United States Patent
Nakamura et al.

(10) Patent No.: US 7,366,454 B2
(45) Date of Patent: Apr. 29, 2008

(54) LONG MAGNET, PRODUCTION METHOD THEREOF, MAGNET ROLLER AND IMAGE FORMING DEVICE

(75) Inventors: Makoto Nakamura, Kanagawa (JP); Mieko Kakegawa, Kanagawa (JP); Sumio Kamoi, Tokyo (JP); Tsuyoshi Imamura, Kanagawa (JP); Kyohta Koetsuka, Kanagawa (JP); Noriyuki Kamiya, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 602 days.

(21) Appl. No.: 10/820,052

(22) Filed: Apr. 8, 2004

(65) Prior Publication Data

US 2004/0258436 A1 Dec. 23, 2004

(30) Foreign Application Priority Data

Apr. 8, 2003 (JP) ..... 2003-104103

(51) Int. Cl.
*H01F 7/00* (2006.01)
*G03G 15/09* (2006.01)
*H05B 6/00* (2006.01)

(52) U.S. Cl. ..... 399/277; 335/302; 335/303; 252/62.53; 252/62.54; 252/62.57; 264/429

(58) Field of Classification Search ..... 399/267, 399/277, 278; 252/62.53, 62.54, 62.57; 335/302–306; 264/429
See application file for complete search history.

(56) References Cited

U.S. PATENT DOCUMENTS 4,793,691 A 12/1988 Enomoto et al.
4,984,873 A 1/1991 Takiguchi et al.
5,044,733 A 9/1991 Kamoi et al.
5,244,741 A 9/1993 Nagano et al.
5,513,026 A 4/1996 Suzuki et al.
5,566,013 A 10/1996 Suzuki et al.
5,970,294 A 10/1999 Narita et al.
5,991,585 A 11/1999 Nakamura
6,070,038 A 5/2000 Imamura et al.
6,112,042 A 8/2000 Imamura et al.
6,198,895 B1 3/2001 Tsuda et al.
6,262,787 B1 7/2001 Kamoi et al.
6,287,246 B1 9/2001 Yoshii et al.
6,330,415 B1 12/2001 Imamura et al.
6,337,957 B1 1/2002 Tamaki et al.
6,342,167 B1 * 1/2002 Kawano et al. ..... 252/62.54
6,379,759 B2 4/2002 Kamoi et al.

(Continued)

FOREIGN PATENT DOCUMENTS

JP 2001-296744 10/2001

OTHER PUBLICATIONS

U.S. Appl. No. 11/353,119, filed Feb. 14, 2006, Imamura.

(Continued)

*Primary Examiner*—Ramon M. Barrera
(74) *Attorney, Agent, or Firm*—Oblon, Spivak, McClelland, Maier & Neustadt, P.C.

(57) ABSTRACT

The long magnet includes a magnet block made of a mixture of rare earth magnetic powder, thermoplastic resin particles, fluidity additive, pigment, wax and charge control agent, and a reinforcing member to reinforce the magnet block. At least part of the reinforcing member is arranged inside of the magnet block.

38 Claims, 9 Drawing Sheets

U.S. PATENT DOCUMENTS

| | | | | |
|---|---|---|---|---|
| 6,473,588 | B2 | 10/2002 | Nakamura | |
| 6,522,855 | B1 | 2/2003 | Katoh et al. | |
| 6,567,638 | B2 | 5/2003 | Nakamura et al. | |
| 6,697,593 | B2 | 2/2004 | Imamura et al. | |
| 6,893,580 | B2 * | 5/2005 | Kawano et al. | 252/62.54 |

OTHER PUBLICATIONS

U.S. Appl. No. 10/998,547, filed Nov. 30, 2004, Kakegawa et al.

U.S. Appl. No. 11/197,548, filed Aug. 5, 2005, Kasai et al.

* cited by examiner

LONG MAGNET, PRODUCTION METHOD THEREOF, MAGNET ROLLER AND IMAGE FORMING DEVICE

CROSS-REFERENCE TO RELATED APPLICATIONS

The present document incorporates by reference the entire contents of Japanese priority document, 2003-104103 filed in Japan on Apr. 8, 2003.

BACKGROUND OF THE INVENTION

1) Field of the Invention

The present invention relates to a long magnet, its production method, a magnet roller and an image forming device.

2) Description of the Related Art

In the image forming devices such as electrophotographic-type copy machines, printers, facsimiles, and multifunction peripherals, developing device have been widely used to develop a latent image formed on an image carrier with the use of a developer made of two components of toner and carrier. Such a developing device develops the latent image in the following manner. That is, forms a magnetic brush by magnetic adsorption of a developer to the outer peripheral surface of a developing roller, and selective supplies and adheres toner to a latent surface of an image carrier that is facing the magnetic brush by an electric field between the image carrier where an electrostatic latent image is formed and a sleeve applied with electrical bias in a developing region (a region where an electric field capable of development between the developing roller and the image carrier is secured).

As disclosed in Japanese Patent Application Laid-Open Publication No. 2001-296744, the developing rollers require high magnetic characteristic for magnet materials due to a small angle between the poles in the developing polar portion. Moreover, the accuracy of the developing polar portion is required to be high.

These requirements cannot be fulfilled with the known materials or know structures of the rollers. For example, the ferrite-type magnets do not have sufficient magnetic characteristic. The rare earth magnets have high magnetic characteristic; however, they are costly. One approach is to use the rare earth magnet only for the developing pole, which requires high magnetic characteristic, and use the ferrite-type magnet for other poles. To meet the requirements described above, a magnet block is made of rare earth magnet and fit in a groove formed on a cylindrical plastic magnet to form a magnet roller, and then the magnet roller is used for, the developing roller. It should be noted that the magnet block can be made by sintering, extrusion molding, injection molding or compression molding.

However, 100 millimeters is generally a limit for the length of a sintered magnet block made of rare earth. It is difficult to make a 300 millimeters long magnet block that is used for a developing roller. A 300 millimeters long magnet block can be made by extrusion molding or injection molding; however, achieving uniform accuracy of dimension covering 300 millimeters without torsion or deflection is difficult. Furthermore, due to the molding characteristics, fluidity is necessary to some extent, and this causes an increase in proportion of binder and resin, and it is difficult to enhance the magnetic characteristic by increasing the content of magnetic powder in the magnet block. Therefore, a long magnet block is not easy to obtain even by sintering, extrusion molding or injection molding.

On the other hand, since a high magnetic force is achieved in a magnet block made by compression molding, it is possible and advantageous to increase the content of magnetic powder in the magnet block. There is, however, a problem that such a magnet block has a poor mechanical strength, particularly, flexural strength. Although a magnet block formed by compression molding is preferable in view of the magnetic force, the magnet block does not have enough strength required for delivery after having been taken out from the mold and a series of processes such as fitting of the magnet block in a groove of cylindrical plastic magnet, resulting in cracks and damage that were easy to occur.

SUMMARY OF THE INVENTION

It is an object of the present invention to solve at least the problems in the conventional technology.

A long magnet according to one aspect of the present invention includes a magnet block made of a mixture of rare earth magnetic powder, thermoplastic resin particles, fluidity additive, pigment, wax, and charge control agent; and a reinforcing member to reinforce the magnet block, at least part of the reinforcing member being arranged inside of the magnet block.

A long magnet according to another aspect of the present invention includes a magnet block made of a mixture of rare earth magnetic powder, thermoplastic resin particles, fluidity additive, pigment, wax, and charge control agent; and a plurality of reinforcing members to reinforce the magnet block, at least one of the reinforcing member being arranged on one side of a longitudinal direction of the magnet block.

A manufacturing method of a long magnet according to still another aspect of the present invention includes mixing of rare earth magnetic powder, thermoplastic resin particles, fluidity additive, pigment, wax and charge control agent; and molding a reinforcing member integrally with the mixture in a mold by compression molding.

A magnet roller and an image forming apparatus according to still another aspect of the present invention include the long magnet according to the present invention.

The other objects, features, and advantages of the present invention are specifically set forth in or will become apparent from the following detailed description of the invention when read in conjunction with the accompanying drawings.

DETAILED DESCRIPTION

Exemplary embodiments of a long magnet according to the present invention will now be explained with reference to the accompanying drawings.

Figure 1:
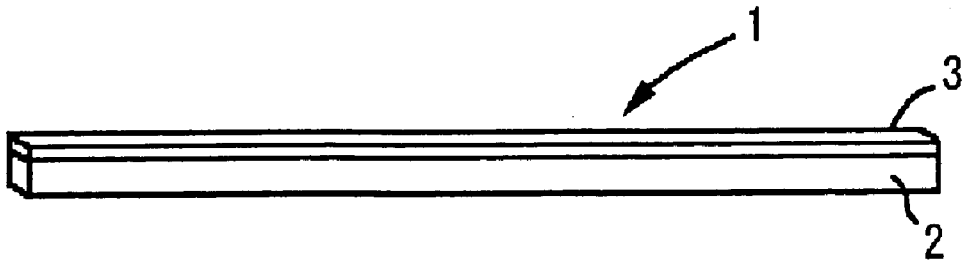
FIG. 1 is a perspective of a long magnet according to an embodiment of the present invention.
Figure 2:
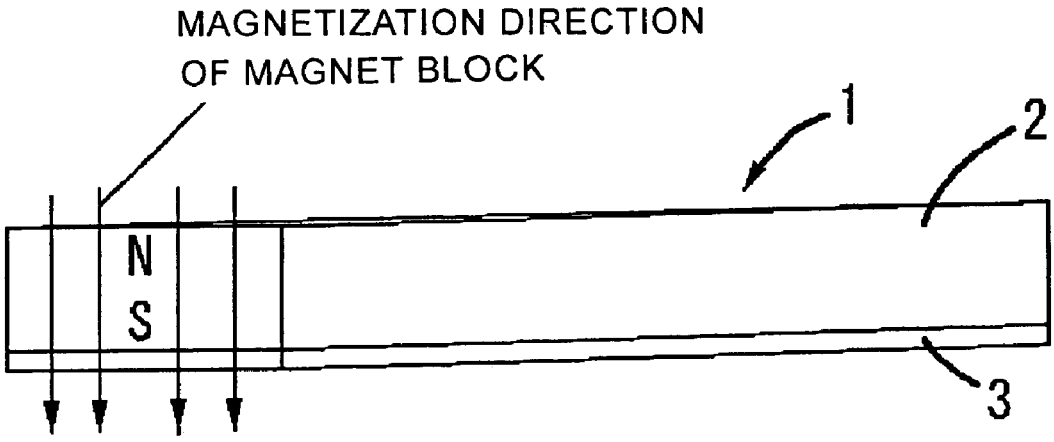
FIG. 2 is schematic to explain the magnetization direction of the long magnet in FIG. 1.

FIG. 1 is a perspective of a long magnet according to an embodiment of the present invention.

A long magnet 1 includes a rectangular magnet block 2 and a reinforcing member 3 that is fixed to a side of the magnet block 2. As the magnet block 2, a plastic magnet block made of a mixture of magnetic powder and a high molecular compound, a rubber magnet block or a magnet block obtained by compression molding of magnetic powder and a high molecular compound in a mold can be used. To enhance the magnetic force of the magnet block 2, it is preferred to use rare earth magnetic powder of Nd-type (Nd—Fe—B etc.) or Sm-type (Sm—Co, Sm—Fe—N etc.) rather than magnetic powder of ferrite-type (Sr ferrite or Ba ferrite) that is generally used. Either type of isotropic or anisotropic rare earth magnetic powder can be used, while it is effective to use anisotropic magnetic powder that has high magnetic characteristic to obtain higher magnetic characteristic.

If the magnet block 2 is required to have a high magnetization, the magnetic powder content is made higher than 80 weight (wt) %. However, to form the magnet block 2 by extrusion molding or injection molding, fluidity is needed to some extent, which leads to an increase in the proportion of binder resin, thus resulting in difficulty in increasing the packing fraction of the magnetic powder. Length of a sintered magnet made of a rare earth material is limited to less than 100 millimeters. Therefore, it is preferred to obtain the magnet block 2 by compression molding. The strength of the magnet block 2 obtained in this way is decreases as the packing fraction of the magnetic powder becomes high. In particular, a perpendicular or diagonal crack in the longitudinal direction that leads to breakage, or a chip at the leading end of the longitudinal direction easily occurs in the long magnet block 2 of about 300 millimeters with a small cross sectional area. To prevent a crack or chip from occurring, the reinforcing member 3 is arranged on a side of the longitudinal direction of the magnet block 2 to increase its strength. The shape of a cross section of the magnet block 2 is not limited to a rectangle but may have various shapes, for example, a semicylindrical.

The material composition of the magnet block 2 will be explained next.

Besides magnetic powder, the magnet block 2 is made of a fluidity additive that is externally added to thermoplastic resin particles such as toner and binder containing pigment, wax and a charge control agent inside. The composition of the binder enhances the orientation of the magnetic powder at the time of the block processing, resulting in a high magnetic force.

The magnetic powder includes ferrite-type magnetic particles such as Ba ferrite and Sr ferrite, and rare earth magnetic particles such as Sm—Fe—N and Nd—Fe—B. The price of rare earth is so high that the structure of the magnet block 2 in which rare earth is arranged only in a portion where high magnetic characteristic is needed is often employed. When a high magnetic force is partly required as in the present invention, a portion of a part made of another material is cut off and the magnet block 2 with a high magnetic force is arranged in the portion cut out.

As to the binder, a charge control agent (CCA), pigment, a material having a low softening point (WAX) are dispersed in a resin such as polyester or polyol and mixed together, and a substance such as silica or titanium oxide is externally added around the mixed particles to allow its high fluidity. This is just the same as so-called toner. The binder is usually produced by a conventional grinding method or polymerization method such as emulsification or suspension polymerization method.

The waxes include paraffin wax, polyolefin wax, Fisher Tropic wax, amide wax, higher fatty acid, ester wax, their derivatives or their graft/block compounds, and the like. It is preferred to add such a wax at about 5 wt % to 30 wt % into toner. When heated, the wax seeps out of the inside of the binder at the time of binder melting, which allows orientation of the magnetic powder to be improved.

The external additives include, for example, metal oxides such as aluminum oxide, titanium oxide, strontium titanate, cesium oxide, magnesium oxide, chromium oxide, tin oxide and zinc oxide, nitrides such as silicon nitride, carbides such as silicon carbide, metal salts such as calcium sulfate, barium sulfate and calcium carbonate, fatty acid metal salts such as zinc stearate and calcium stearate, carbon black, and silica. The particle diameter of the external additive is in the range of 0.1 micrometer to 1.5 micrometers. The addition amount of the additive is 0.01 part to 10 parts by weight (pts. wt.) and preferably 0.05 part to 5 parts wt. with respect to 100 parts. wt. of toner particles. These external additives may be used independently or in combination of several of them. It is preferred for the external additives to be used after hydrophobic treatment. The external additive enhances fluidity of the binder and also is capable of increasing the packing density of the mixed powder when magnetic particles are mixed. The pigments include carbon black, phthalocyanine blue, quinacridone, carmine and the like. In the magnet block, the pigment serves as a marker to evaluate a mixing state and a dispersing state of the magnetic powder and the binder, which is effective in quality management.

The reinforcing member 3 will be explained next. When the flexural strength of the reinforcing member 3 is low, it is disadvantageous in view of its characteristics. It is important for the reinforcing member 3 to have its flexural strength at least higher than that of the magnet block 2. The materials for the reinforcing member 3 include metal materials, polymer materials (rubber, plastic) and magnet materials.

The metal materials include, for example, iron, stainless steel, aluminum. There are magnetic and nonmagnetic materials, and magnetic materials (materials with a high magnetic permeability) are advantageous for enhancement of the magnetic characteristic of the magnet block 2 without impairing its magnetic characteristic. Moreover, when the magnetic characteristic of the magnet block 2 is sufficient, nonmagnetic materials may also be used despite lowering its magnetic characteristic.

The polymer materials include, for example, general plastics such as PP, PE, PA, PC, PI, Teflon (trade mark), urethane, epoxy, phenol EEA and EVA, and rubber materials such as EPDM, CR, BR, NBR, silicone and epichlorohydrin. As the polymer material, plastic is particularly preferred in view of flexural strength. In particular, PA, PI, PC, epoxy, phenol and the like are desirable because of their significantly high flexural strength. In some cases, a reinforcing member 3 with mechanical strength enhanced further by packing fillers such as glass fiber may be used. In this case, the reinforcing member 3 is made thinner, which leads no loss of the volume of the magnet block 2, and thus, results in no loss of high magnetic force.

The magnet materials include ferrite sintered magnetic powder, plastic magnet and rubber magnet. In this case, the magnetic characteristic of the magnet material may be low; however, the magnet material is necessary to have strength higher than that of the magnet block 2. The material for the binder should be selected in consideration of its strength. When the magnet material is used as a reinforcing member, the following effects can be obtained.

When the reinforcing member 3 is arranged in a direction that is orthogonal to the magnetization direction of the magnet block 2, the magnetic characteristic of the long magnet 1 can be represented as: magnetic characteristic of long magnet=(magnetic characteristic of magnet block)+(magnetic characteristic of reinforcing member)

From the above equation, the magnetic characteristic of the long magnet 1 with the reinforcing member 3 and magnet block 2 both magnetized is higher than that of the long magnet 1 having only the magnet block. As the magnetic powder to be added, ferrite-type (Sr ferrite or Ba ferrite) materials or rare earth-type (Nd-type, Sm-type) materials that are generally used can be used, but adding a rare earth-type material is desirable because the magnetic characteristic is enhanced. Both isotropic and anisotropic rare earth magnetic powder can be used. It is effective to use anisotropic magnetic powder to obtain a higher magnetic characteristic for a magnet block formed by compression molding because the anisotropic magnetic powder has a higher magnetic characteristic.

To maintain strength, it is more effective to use a metal material for the reinforcing member 3 than to use a plastic material because the metal material has a flexural strength higher than that of the plastic material. Further, when a magnetic material is used and arranged perpendicularly to the magnetization direction of the magnet block as well as on the back surface of the magnet face to be used, the magnetic characteristic of the whole long magnet is enhanced. When a nonmagnetic material is used, there is no effect on the magnetic characteristic due to the arrangement position of the reinforcing member.

Further, the reinforcing member 3 can be composed of equal to or more than two kinds of materials. As long as reinforcement effect can be obtained for the reinforcing member 3, an optimal combination may be selected from, for example, a combination of magnetic metal and magnet material or magnetic material and nonmagnetic material based on the good balance between reinforcement effect and magnetic characteristic. In this case, it may be acceptable to laminate different materials, incorporate them inside, or further provide the reinforcing member with an anchor or the like made of a material with a different property and then engage it into the magnet block 2.

The reinforcing member 3 can have different shapes and can be arranged at different places in or on the magnet block 2. The reinforcing member 3 may be made to cover the magnet block 2 from all the sides, which allows the strength to be increased. On the other hand, the reinforcing member 3 may be arranged on only some of the sides of the magnet block 2. It is preferable that the reinforcing member 3 is flexible. The reinforcing member 3 may be made flexible by adding thin metal materials or polymer materials. The polymer, materials include cellulose triacetate, fluorine resin-type films, polyethylene, polycarbonate, polysulfone, polypropylene, polyester, polyvinyl alcohol, polyvinyl chloride, polystyrene, polyimide, polyurethane, polyethersulfone and the like.

To provide the reinforcing member 3 with flexibility even when magnetic powder is added, the proportion of binder resin is required to be increased, resulting in a lower content of the magnetic powder. This leads to the magnetic characteristic of the magnet block 2 higher than that of the reinforcing member 3. For this reason, when the reinforcing member 3 is too thick, the magnetic characteristic of the whole long magnet 1 becomes low. On the other hand, when the reinforcing member 3 is too thin, cracks occur in the reinforcing member 3 due to the weight of the block. Accordingly, the reinforcing member 3 is effective in a film-like shape having an about 0.1 millimeter to 1 millimeter thickness. In this instance, PET, PA, PI, PC, epoxy, phenol or the like may be used for the material.

Figure 3:
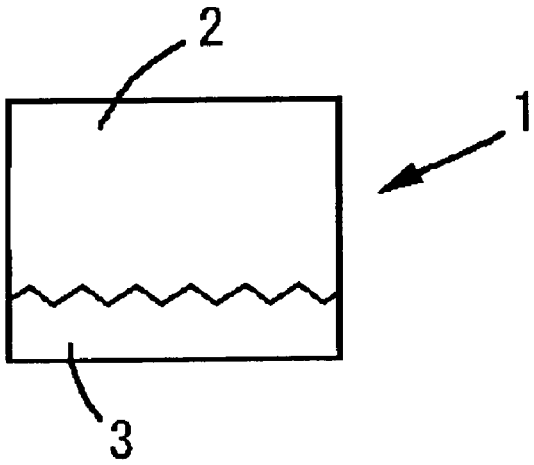
FIG. 3 is to explain a contact of a magnet block and a reinforcing member of the long magnet in FIG. 1.

It is required for the reinforcing member 3 to be securely joined at an interface to the magnet block 2. To join the reinforcing member 3 to the magnet block 2 securely, the contact face of the reinforcing member 3 to the magnet block 2 may be made rough as shown in FIG. 3. When the contact face of the reinforcing member 3 is rough, the surface area becomes large, which means a larger contact area between the reinforcing member 3 and the magnet block 2, resulting in better adhesion. It should be noted that the rough surface may be formed with a sand blast or a file. The magnetic characteristic of the magnet block 2 is higher than that of the reinforcing member 3. Therefore, when the contact face of the magnet block 2 is made rough, the whole magnetic characteristic of the long magnet 1 may decrease. Therefore, it is preferable that the contact face of the reinforcing member 3 is made rough rather than that of the magnet block 2.

Figure 4:
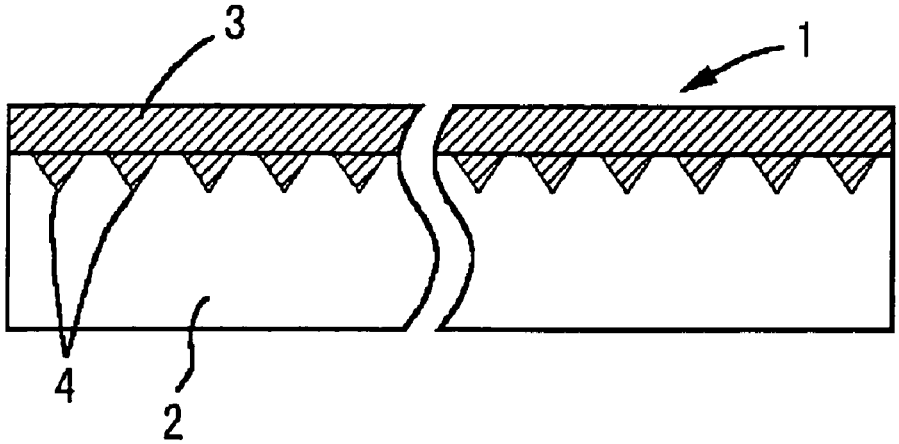
FIG. 4 is to explain a contact of the magnet block and the reinforcing member of the long magnet in FIG. 1.
Figure 5A:
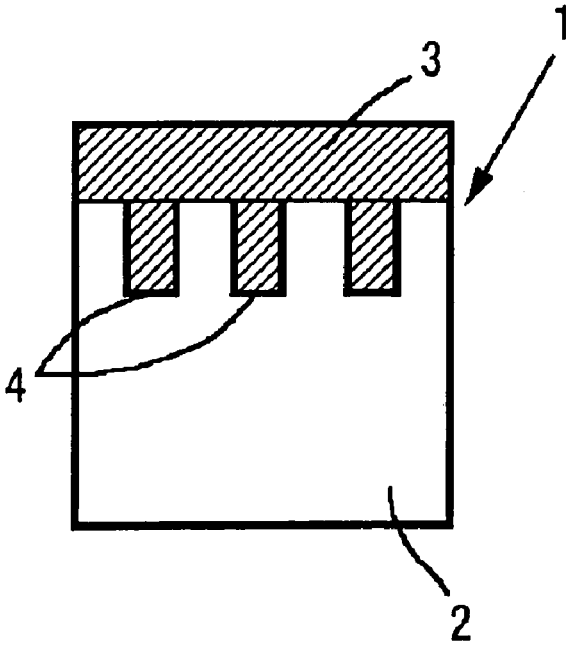
FIGS. 5A and 5B are to explain a contact of the magnet block and the reinforcing member of the long magnet in FIG. 1.
Figure 5B:
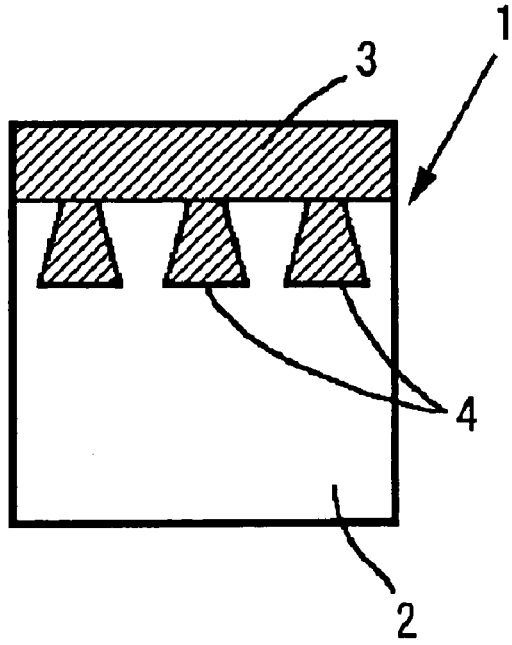

A structure where portions of the reinforcing member 3 intrude into the magnet block 2 may be acceptable instead of forming a rough contact face as described above. In the example in FIG. 4, a plurality of pyramid-like or conical protrusions 4 are formed on the contact face of the reinforcing member 3 and the protrusions 4 intrude into the magnet block 2. In such a structure, secure joining of the reinforcing member 3 to the magnet block 2 is possible. The form of protrusion 4 is not necessarily to be pyramid-like or conical, but may be effective in a rectangular or trapezoid shape in cross section as shown in FIGS. 5A and 5B.

Figure 6A:
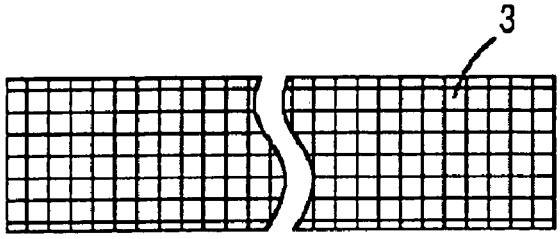
FIGS. 6A and 6B are explanatory drawings of a reinforcing member that is a mesh.
Figure 6B:
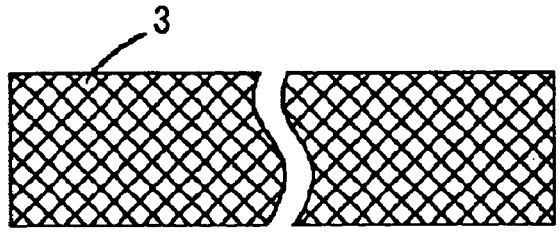
Figure 7:
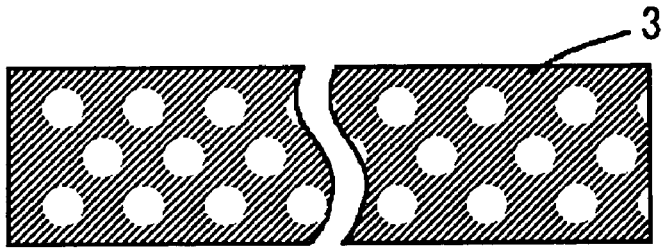
FIG. 7 is an explanatory drawing of a reinforcing member that is a punching metal.

A mesh as shown in FIGS. 6A and 6B or a material with through-holes like punching metal as shown in FIG. 7 may be acceptable for the material of the reinforcing member 3. When such a material with through-holes is used, joining of the reinforcing member 3 to the magnet block 2 is secured, which leads to advantages that the volume of the reinforcing member 3 is decreased without loss of its strength, the volume of the magnet block 2 is increased by the volume decreased, its magnetic force is also increased, and the like.

Figure 8A:
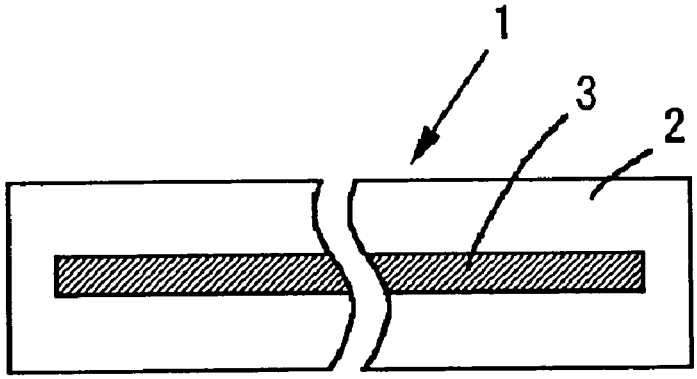
FIGS. 8A and 8B are cross sections of a long magnet in which a reinforcing member is embedded in a magnet block.
Figure 8B:
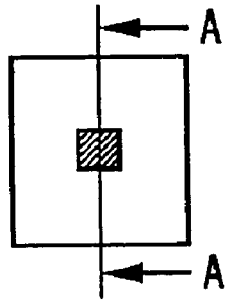
Figure 9A:
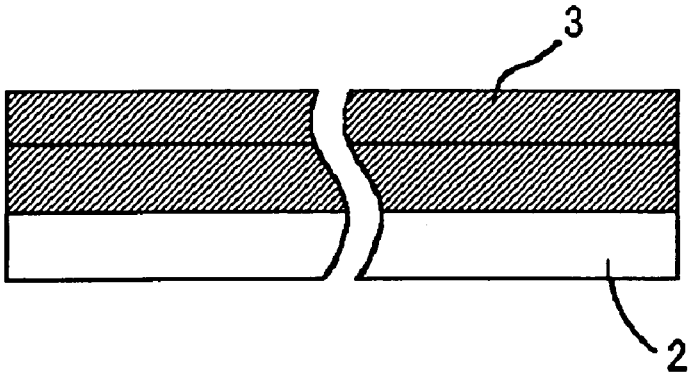
FIGS. 9A and 9B are cross sections of a long magnet in which a reinforcing member is embedded in a magnet block.
Figure 9B:
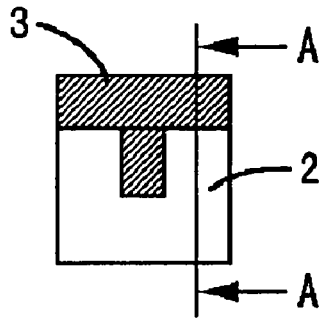
Figure 10A:
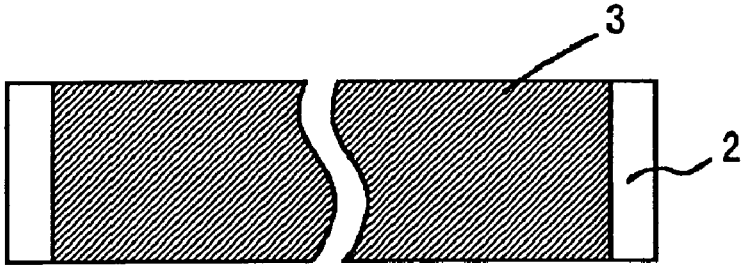
FIGS. 10A and 10B are cross sections of a long magnet in which a reinforcing member is embedded in a magnet block.
Figure 10B:
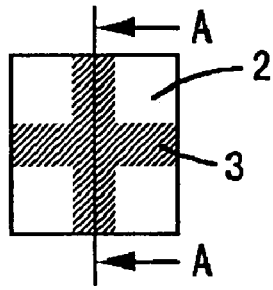

The reinforcing member 3 may be embedded inside of the magnet block 2 as shown in FIGS. 8A and 8B instead of arranging it on a side of the magnet block 2. The enforcement member 3 to be embedded may be shaped like thin plate, thin plate with through-holes, bar that is circular, triangular, square or the like in cross section, or the like. Moreover, only part of the reinforcing member 3 may be embedded inside of the magnet block 2 as shown in FIGS. 9A, 9B, 10A, 10B.

Figure 11:
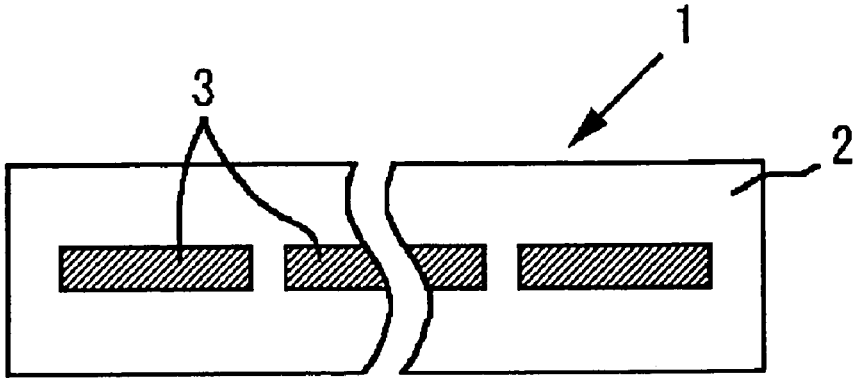
FIG. 11 is a cross section of a long magnet in which a reinforcing member is embedded only at specific portions in a magnet block.
Figure 12:
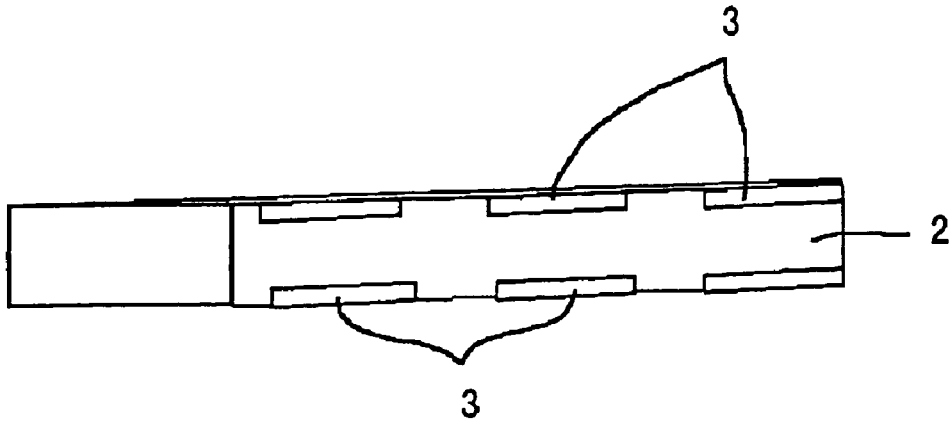
FIG. 12 is perspective of a long magnet in which a reinforcing member is arranged at specific portions on a surface of a magnet block.

The reinforcing member 3 described above is arranged to cover approximately the whole length of the longitudinal direction of the magnet block 2. Therefore, the length of the reinforcing member 3 is the same as that of the longitudinal direction of the magnet block 2 or is close to that of the magnet block 2. In the structure of the embodiment shown in FIG. 11, short reinforcing members 3 are arranged with spacing. The reinforcing members 3 may be arranged with a regular interval, while, as shown in FIG. 12, they may be arranged on sites corresponding to the sites that need reinforcement because of being mechanically chucked and the like after the magnet block 2 is formed or when it is installed in other parts. It should be noted that the reinforcing members 3 arranged with spacing may be arranged on the sides or embedded inside of the magnet block 2.

Figure 13:
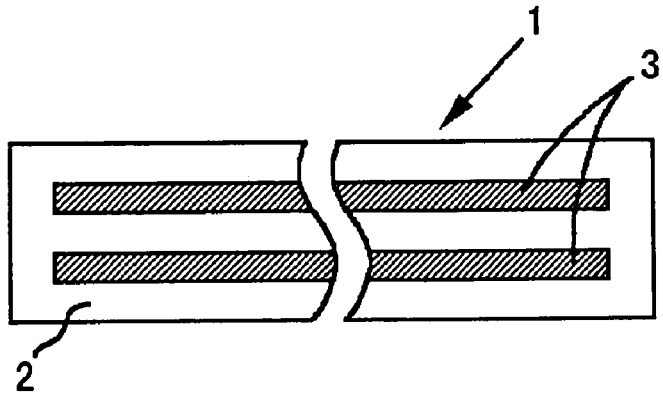
FIG. 13 is a cross section of a long magnet in which a plurality of reinforcing members are embedded in a magnet block.
Figure 14:
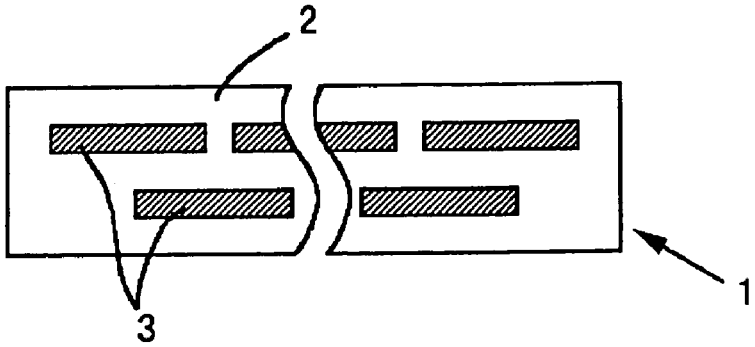
FIG. 14 is a cross section of a long magnet in which a plurality of reinforcing members are embedded only at specific portions in a magnet block.
Figure 15A:
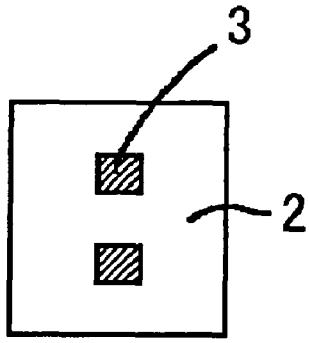
FIGS. 15A and 15B are explanatory drawings for explaining arrangement of reinforcing members in a magnet block.
Figure 15B:
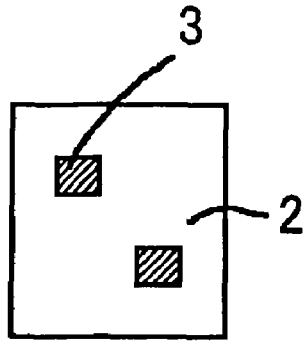

When the reinforcing member 3 to be embedded is in a layer, a plurality of its layers may be arranged as shown in FIG. 13. When the reinforcing members 3 arranged with spacing are used, a staggered row shown in FIG. 14 may be acceptable. In this case, the embedded reinforcing members 3 are arranged in a plurality of layers in the vertical direction or the diagonal direction as shown in FIGS. 15A and 15B.

Figure 16:
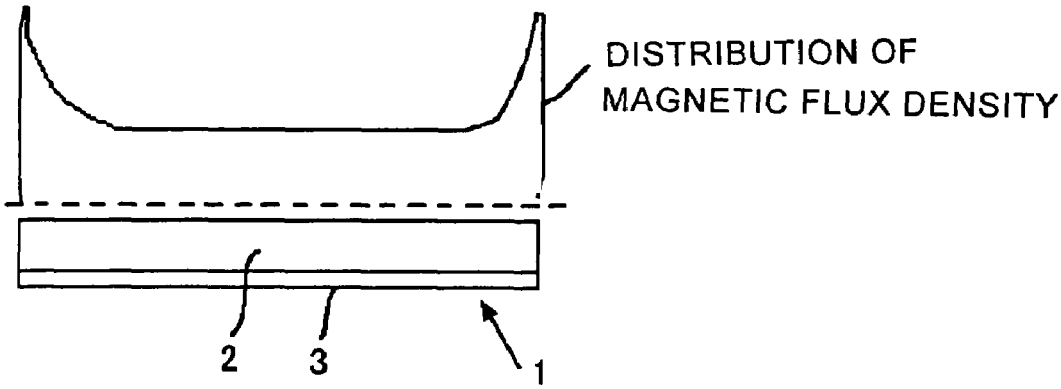
FIG. 16 is an explanatory drawing to explain the distribution of magnetic flux density of the long magnet.

Magnet has a property that magnetic flux density is generally high toward its ends irrespectively of its shape and length (edge effect). Because of this property, the magnetic flux density of both ends of the long magnet 1 is higher than that at the center, which causes a nonuniform magnetic characteristic of the longitudinal direction as shown in FIG. 16. In the method that prevents the nonuniformity and makes the magnetic characteristic uniform, the length of the long magnet 1 is made longer than that of the range necessary for the magnetic characteristic. As the result, the part becomes large and the cost may be increased, which is not desirable.

Figure 17:
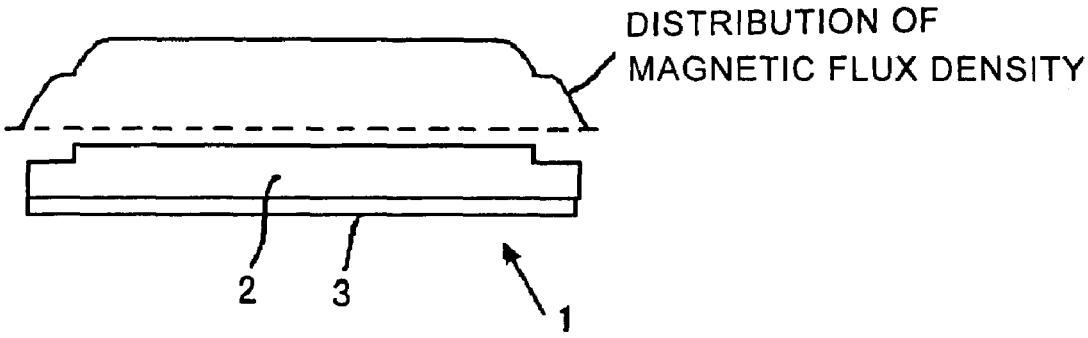
FIG. 17 is an explanatory drawing of a long magnet improved in edge effect.
Figure 18:
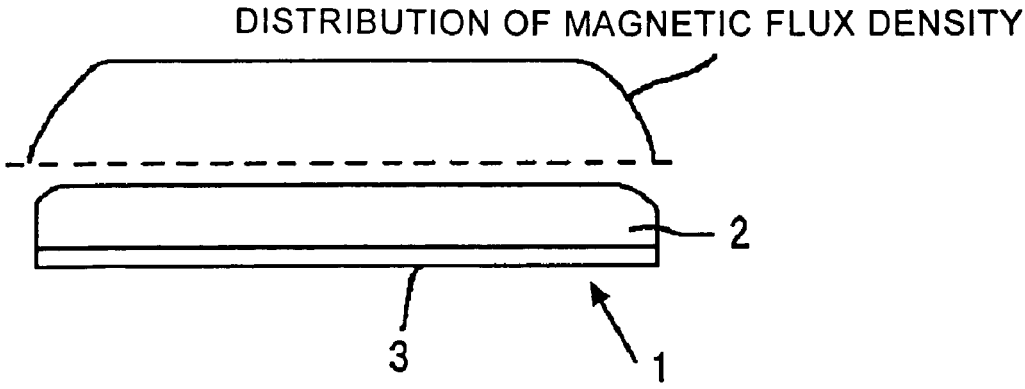
FIG. 18 is an explanatory drawing of a long magnet further improved in edge effect.

Thus, the thickness of the magnet block 2 with high magnetic characteristic is altered in the longitudinal direction, and the distance to the region where the magnetic characteristic is needed is altered. As the result, the distribution of magnetic flux density of the longitudinal direction can be controlled. In this case, the thickness of both ends of the magnet block 2 is altered by providing steps 5 as shown in FIG. 17, which leads to possible generation of difference in level in the distribution of peak magnetic flux density of the longitudinal direction. When the level of both ends of the magnet block 2 is altered by providing smooth gradient as shown in FIG. 18, the distribution of peak magnetic flux density also shifts smoothly, resulting in more uniform distribution of the peak magnetic flux density.

Figure 19:
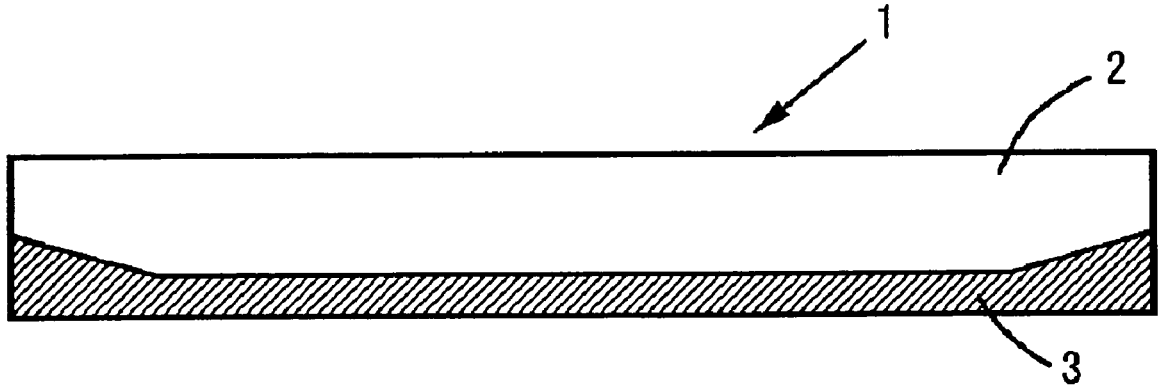
FIG. 19 is a cross section of a long magnet improved in edge effect.

When the magnet block 2 is formed by compression molding, the reinforcing member 3 with different thicknesses in the longitudinal direction as shown in FIG. 19 is set in the mold, followed by compressing magnetic powder and binder. Thus, a long magnet that has a uniform magnetic characteristic in the longitudinal direction may be produced. That is, a reinforcing member with a larger thickness at its ends and a smaller thickness at the center is placed in a compression mold, magnetic powder and binder are put on it and compressed, giving rise to a magnet block with a smaller thickness at its ends and a larger thickness at the center. The dimensions of the long magnet obtained through such steps are different in the longitudinal direction, which allows prevention of edge effect in the region where the magnetic characteristic is needed.

Altering the magnetic characteristic in the reinforcing member 3 can overcome the edge effect of the magnet block 2. It should be noted that the magnetic characteristic and arrangement location must be taken into consideration because it is assumed that edge effect is present in the reinforcing member 3.

Tape made in the same dimension as that of the magnet block 2 and magnetized is not used but both ends of the tape made in a long shape and magnetized are cut off to be used as the reinforcing member 3, thereby eliminating the influences of the edge effect. Further, when the reinforcing member 3 is made shorter than the magnet block 2 and the face to be reinforced is brought to the surface on which the reinforcing member is arranged on the edge portion of the magnet block 2, the edge portion parts from the surface of the reinforcing member 3 by its thickness. Thus, the apparent magnetic characteristic can be made uniform by having a distance from the surface. Furthermore, the magnetic characteristic can also be made uniform by arranging reinforcing members with high magnetic characteristic at the center and low magnetic characteristic at both ends of the magnet block 2.

The magnet block 2 and the reinforcing member 3 may be formed separately and then attached to each other. Moreover, when the magnet block 2 is formed by compression molding, the reinforcing member 3 is first put into the compression mold and then the magnet block 2 is compressed to yield an integrally molded magnet. When the magnet block 2 is obtained by compression molding, breakage and chip easily occur at the time of molding and demolding. In integral molding, magnet block 2 is reinforced by the reinforcing member 3 at the time of compression of the magnet block 2, which is effective for prevention of breakage and chip.

An image forming unit of image forming apparatus using the long magnet according to the present invention for a developing roller will be explained based on the structure shown in FIG. 20.

Figure 20:
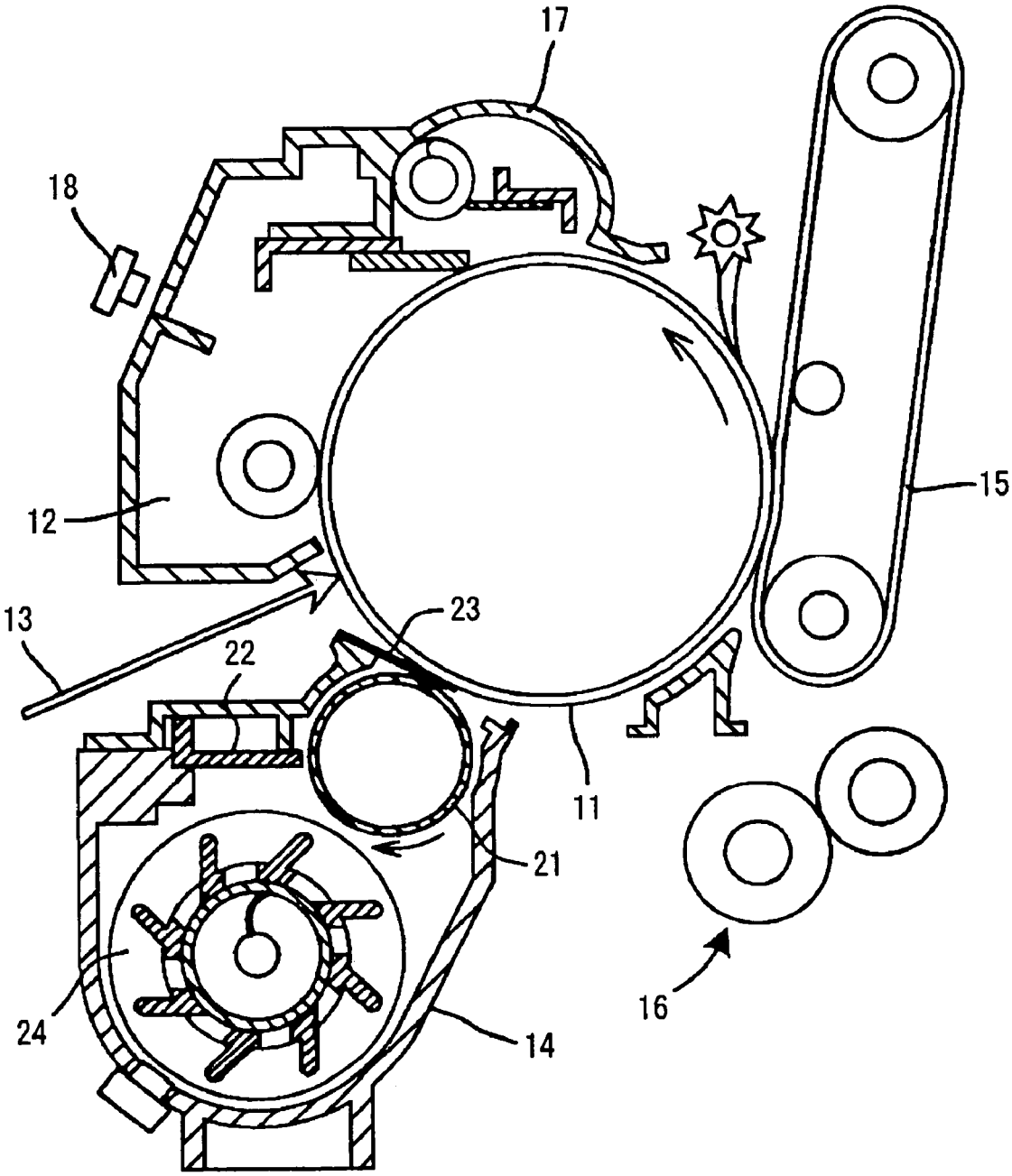
FIG. 20 is a side view of main parts of an image forming device.

In the structure shown in FIG. 20, an charging device 12 to charge the surface of a photosensitive drum 11 that serves as an electrostatic latent image carrier, exposure 13 of laser to form a latent image on the surface uniformly charged, a developing device 14 to form a toner image by attaching charged toner to the latent image on the drum surface, a transfer device 15 to transfer the toner image formed on the drum to a sheet of recording paper, a cleaning device 17 to remove residual toner on the drum, and an erase lamp 18 to erase residual potential on the drum are arranged in order around the periphery of the drum.

With the structure, an electrostatic latent image is formed by the exposure 13 on the photosensitive member 11 whose surface is uniformly charged by the charging roller of the charging device 12 and a toner image is formed by the developing device 14. The toner image is transferred from the surface of the photosensitive drum 11 to a transfer material delivered from a paper feeding tray not shown by the transfer device 15 including a transfer belt and the like. In the process of the transfer, the transfer material that adheres electrostatically to the photosensitive drum 11 is separated from it by a separation claw. The unfixed toner image carried by the transfer material is fixed to the transfer material by heat, pressure and the like when the transfer material passes through a fixing device 19. On the other hand, the residual toner on the photosensitive drum 11 that has not been transferred is removed by the cleaning device 17 and recovered. The photosensitive drum 11 from which the residual toner has been removed is initialized by the erase lamp 18 to be ready for the next print cycle of image formation. The numeral 16 represents a resist roller to deliver a transfer material from the paper feeding tray not shown at the time when a toner image is formed on the photosensitive drum 11.

In the developing device 14, a developing roller 21 arranged opposite and adjacent to the photosensitive drum 11 is provided. The opposing part between the developing roller 12 and the photosensitive drum 11 is the development region. It should be noted that the numeral 22 represents a height of bead chains of developer, that is, a doctor blade to control the amount of developer on a developing sleeve, the numeral 23 represents an inlet seal member, and the numeral 24 represents a screw to pump the developer in the casing of the developing device with stirring to the developing roller 21.

Figure 21:
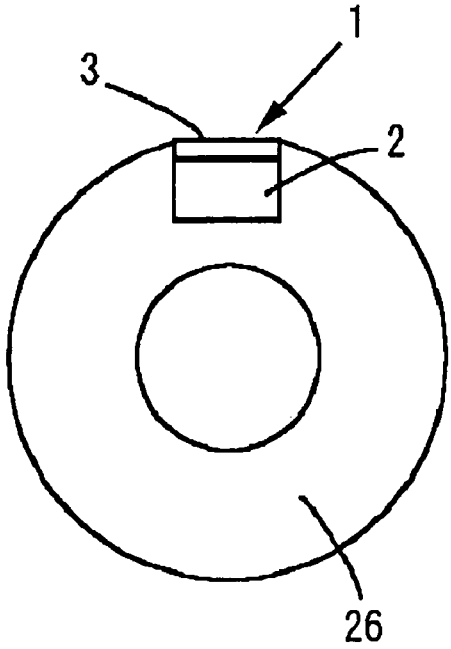
FIG. 21 is a side view of a magnet roller that can be used as a developing roller in the image forming device in FIG. 20.

In the developing roller 21, a cylindrical developing sleeve 25 made of a nonmagnetic substance such as aluminum, brass, stainless steel, or conductive resin is provided. The developing sleeve 25 is rotated clockwise in the figure by a rotation driving mechanism not shown. A magnet roller 26 to form magnetic field so as to generate bead chains of developer on the peripheral surface of the magnet roller 26 as shown in FIG. 21 is fixed in the developing sleeve 25. The magnet roller 26 has a plurality of magnetic poles, one of which is a delivery pole to deliver the developer pumped up to the developing region and the other is a delivery pole to deliver the developer in the region after development. A concave groove is provided in the longitudinal direction in the developing region and the long magnet 1 of the present invention is arranged in the groove as the main developing pole.

The long magnet 1 according to the present invention is arranged in part of the magnet roller 26 with magnetic characteristic inferior to that of the magnet block 2. This allows obtainment of the magnet roller 26 with a high magnetic force even though it has a small diameter. Using such a magnet roller 26 for the developing roller 12 as described above allows prevention of carrier from scattering and adhering as well as prevent thin-spot at the trailing edge of an image from occurring, resulting in a high-quality image. Note that a magnet roller provided with the long magnet 1 in its part can be used for, for example, a cleaning roller and magnetic brush charging roller besides the developing roller.

EXAMPLES

A magnet block was formed in the method as described below.

A compound material was prepared by blending 93 pts. wt. of anisotropic Nd—Fe—B-type magnetic powder (MFP-12), a product of Aichi Steel Corporation, with 7 pts. wt. of fine particles of the following compositions and compound ratio of and dispersed by stirring.

The average particle diameter of MFP-12 used is about 102 micrometers, the softening point of the thermoplastic resin used is 67 degrees C. and its average diameter is about 7.3 micrometers.

| | |
|---|---|
| Thermoplastic resin | |
| (1) Polyester resin | 79 pts. wt. |
| (2) Styrene acryl resin | 7 pts. wt. |
| Pigment | |
| Carbon black | 7.6 pts. wt. |
| Charge control agent | |
| Zirconium salicylate | 0.9 pt. wt. |
| Release agent | |
| Composition of carnauba wax and rice wax | 4.3 pts. wt. |
| Fluidity additive | |
| Hydrophobic silica | 1.2 pts. wt. |

The obtained compound was packed in a metal mold with a content of a 2.3 millimeter width, 6.0 millimeter height and 306 millimeter length.

Direct electric field was applied so as to generate 13,000 (oersted (Oe)) magnetic field and pressing pressure was applied at 5.5 ton/cm$^2$ in an applied magnetic field state at room temperature to carry out magnetic field molding. At this time, a vertical magnetic field molding method was employed in the magnetic field direction that is the width direction of the magnet block 2 as shown in FIGS. 8A and 8B. The dimension of the obtained magnet block was 2 millimeters in width, 3 millimeters in height and 306 millimeters in length, and its density was 5.3 g/cm$^3$. After heat treatment for 30 minutes at 90 degrees C., pulse polarization was carried out at 25 tesla (T) in generating magnetic field and molding of the magnet block 2 was completed. Forming method of magnet roller Ninety-one parts by weight of Anisotropic Sr ferrite and 9 pts. wt. of each powder substance of EEA (ethylene-ethyl acrylate copolymer) and 1 pt. wt. of low molecular weight PP (for 100 resin) were blended, kneaded with a biaxial sand mixer, and then pelletized. Using the obtained pellets, a cylindrical magnet roller with about ϕ 14 millimeters in which a groove was formed in a part was extruded by a monoaxial extruder under applying magnetic field, and cut in a predetermined length after temporary demagnetization, followed by inserting a core and magnetizing to yield a magnet roller.

As to the developing roller, after obtaining the magnet roller, the magnet block is embedded and fixed in the groove of the magnet roller (developing pole). The fixing was-carried out with a cyanoacrylate-type adhesive. At this time, the arrangement direction of the developing roller was changed so that the 2 millimeter-width direction may be changed to the height direction.

Although vertical magnetic field molding is used in the present example, even transverse magnetic field molding may be possible to mold integrally with the reinforcing member if its arrangement and strength are taken into consideration.

Example 1

A plate of SUS304 with a 0.5 millimeter-thickness was used for the reinforcing member. One reinforcing plate smaller than the inner dimension of the mold by −0.01 millimeter was placed on the bottom surface of the mold. Next, after a cyanoacrylate-type adhesive (high viscosity type) was coated over for adherence of the reinforcing plate, a compound material of the Nd—Fe—B-type powder and the binder resin was measured, and then, a small amount of the compound material was put over the bottom surface of the mold. Then, the reinforcing plate of SUD304 with a 0.5 millimeter-thickness was placed perpendicularly to the reinforcing plate on the bottom surface. Next, the remaining compound material was packed in the mold, and compressed and molded under the press conditions, thereby obtaining a long magnet block in which the magnetic member and the reinforcing member are integrally molded.

Example 2

For the reinforcing member, a reinforcing member (product of Sumitomo Metal Industries Ltd.) with a 1 millimeter-thickness premolded by compression molding of 91 pts. wt. of isotropic Nd—Fe—B-type magnet powder (MQP-b) and 9 pts. wt. of epoxy resin was used. Triangle protrusions 4 were formed on the reinforcing member as shown in the figure. One reinforcing plate smaller than the inner dimension of the mold by −0.01 millimeter was placed on the bottom surface of the mold. Next, after measuring the compound material of Nd—Fe—B-type powder and binder resin, it was packed in the mold, and compressed and molded under the press conditions, thereby obtaining a long magnet block in which the magnet member and the reinforcing member are molded integrally (in the form shown in the figure).

Example 3

Punching metal of SUS304 with a 0.6 millimeter-thickness, 0.8 millimeter ϕ punched holes and 50% punched hole rate was used as the reinforcing member. After measuring the compound material of Nd—Fe—B-type powder and binder resin, it was packed up to about half of the mold, and then a mesh smaller than the inner dimension of the mold by −0.01 millimeter was placed in the mold. After this, the remaining compound material was packed in the mold, and compressed and molded under the press conditions, thereby obtaining a long magnet block in which the magnet member and the reinforcing member are molded integrally (in the form shown in the figure).

Example 4

A mesh of SUS304 with a 0.34 millimeter wire diameter and 0.5 millimeter openings was used as the reinforcing member. One mesh smaller than the inner dimension of the mold by −0.01 millimeter was placed on the bottom surface of the mold. Then, after measuring the compound material of Nd—Fe—B-type powder and binder resin, it was packed up to about half of the mold and another mesh was placed on the compound material. Then, the remaining compound material was packed in the mold, and compressed and molded under the press conditions, thereby obtaining a multi-layered long magnet block in which the magnet member and the reinforcing member are molded integrally.

Example 5

After placing the reinforcing member of Example 2 on the bottom surface of the mold, the compound material of Nd—Fe—B-type powder and binder resin was measured, its small amount was put in the mold, and the reinforcing member described in Example 1 was arranged in the direction perpendicular to the bottom surface of the mold. Then, the remaining compound material was packed in the mold, compressed and molded under the press conditions, thereby obtaining a multi-layered long magnet block in which the magnet member and the reinforcing member are molded integrally.

Example 6

A plate of SUS304 with a 2 millimeter-width, a 0.5 millimeter-thickness and a 300 millimeter-length used as the reinforcing member was attached and fixed to the magnet block by cyanoacrylate-type adhesive (high viscosity type) as shown in FIG. 3 to obtain a long magnet.

Example 7

For the reinforcing member, a reinforcing member (product of Sumitomo Metal Industries Ltd.) with a 2 millimeter-width, a 1 millimeter-thickness and a 300 millimeter-length premolded by compression molding of 91 pts. wt. of isotropic Nd—Fe—B-type magnet powder (MQP-b) and 9 pts. wt. of epoxy resin was used. In a manner similar to that in Example 6, the reinforcing member was attached and fixed to the magnet block by cyanoacrylate-type adhesive as shown in FIG. 3 to obtain a long magnet.

Comparative Example 1

The case where the reinforcing member is not provided in Example 1, that is, the case of only the magnet block.

Comparative Example 2

A compound material prepared by mixing 91 pts. wt. of anisotropic Nd—Fe—B-type magnet powder (MFP-12), a product of Aichi Steel Corporation, and 9 pts. wt. of silane coupling agent with stirring was packed in the mold, and then applied with direct current electric field so as to generate 13,000 (Oe)) magnetic field, and a pressing pressure was applied at 5.5 ton/cm$^2$ in an applied magnetic field state at room temperature to carry out magnetic field molding. The dimension of the magnet block was 2 millimeters wide, 3 millimeters high and 306 millimeters long. The reinforcing member is not provided.

Figure 22:
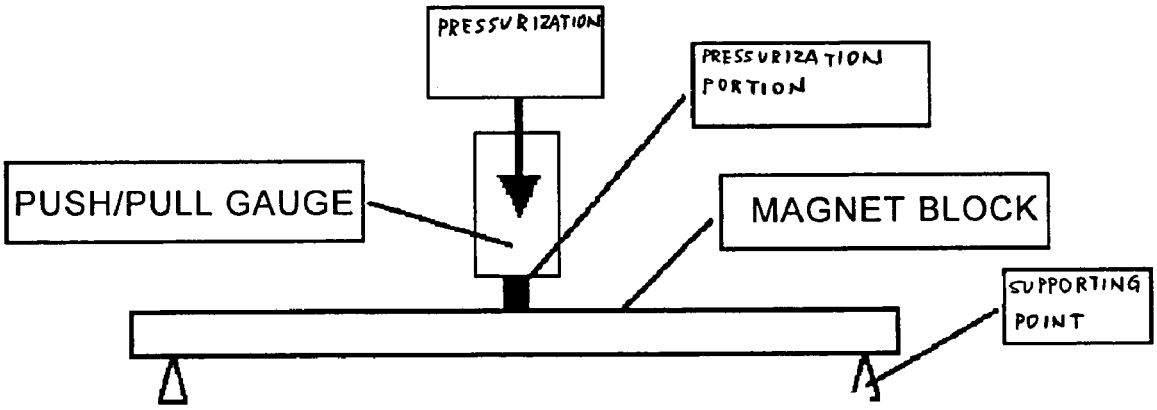
FIG. 22 is a test tool used to evaluate the strength of the long magnet.

Strength tests for Examples 1 to 7 and Comparative examples 1 and 2 according to the present invention were carried out along the outline shown in FIG. 22.

The test method is as follows: with push/pull gauge (20 N), the tip of the gauge was allowed to come in contact with the center portion of the long magnet block and then pressurized. The force at the time of breakage of the magnet block was measured. The force at this time was defined as magnet strength. It has been known that magnet strength required for taking the magnet block out of the mold, delivering and arranging it in the groove of the magnet roller is equal to or higher than 10 N pressure force.

TABLE 1

| | Magnet strength | Judgment |
|---|---|---|
| Example 1 | 12.5 | ○ |
| Example 2 | 13.5 | ○ |
| Example 3 | 12.0 | ○ |
| Example 4 | 14.0 | ○ |
| Example 5 | 12.0 | ○ |
| Example 6 | 12.0 | ○ |
| Example 7 | 13.0 | ○ |
| Comparative example 1 | 4.5 | x |
| Comparative example 2 | 6.0 | x |

where ○: equal to or higher than 10 N
x: lower than 10 N

The results in Table 1 show the evaluation of magnetic strength. As is clear from Table 1, it was found that the magnet strengths of Examples 1 to 7 were all good, that is, their magnet strengths were equal to or higher than 10 N, whereas the magnetic strengths of Comparative examples 1 and 2 did not reach 10 N.

According to the present invention, the long magnet includes a magnet block made by mixing rare earth magnetic powder, thermoplastic resin particles, fluidity additive, pigment, wax and charge control agent, and a reinforcing member to reinforce the magnet block, wherein at least part of the reinforcing member is arranged inside of the magnet block. Therefore, the reinforcing effect of the long magnet with a high content of magnetic substance powder can be enhanced.

Moreover, the long magnet includes a magnet block made by mixing rare earth magnetic powder, thermoplastic resin particles, fluidity additive, pigment, wax and charge control agent, and a reinforcing member to reinforce the magnet block, wherein at least one of the reinforcing members is arranged on one side of the longitudinal direction of the magnet block. Therefore, the reinforcing effect of the long magnet with a high content of magnetic substance powder can be enhanced.

Furthermore, the reinforcing member is made of metal. Therefore, the use of a metal with a high strength allows high efficiency of reinforcement of the long magnet despite a small volume of the reinforcing member and prevention of occupying a larger volume of the magnet block.

Moreover, the reinforcing member is made of a magnetic material. Therefore, when magnetization is applied in the direction orthogonal to the reinforcing member, the magnetic characteristic of the magnet block is not impaired.

Furthermore, the reinforcing member is made of a magnet material. Therefore, the magnetic characteristic of the magnet block is not impaired or in some cases, the magnetic characteristic can be enhanced. Moreover, allowing the reinforcing member to have a strength higher than that of the magnet block prevents breakage.

Moreover, the reinforcing member is made of a flexible material. Therefore, a long magnet excellent in mechanical strength and good for productivity can be provided.

Furthermore, the flexible material contains magnetic powder. Therefore, a long magnet excellent in magnetic characteristic and mechanical strength as well as good for productivity can be provided.

Moreover, the magnetic powder is rare earth-type magnetic powder. Therefore, the magnetic characteristic of the reinforcing member itself is enhanced, thereby providing a long magnet excellent in magnetic characteristic and mechanical strength as well as good for productivity.

Furthermore, the reinforcing member is made of equal to or more than two kinds of materials. Therefore, a long magnet with a higher magnetic force and a higher strength can be provided.

Moreover, the flexural strength of the reinforcing member is higher than that of the magnet block. Therefore, a long magnet with a high strength can be provided.

Furthermore, the reinforcing member has the same length as that of the longitudinal direction of the magnet block and is arranged to cover the whole length of the longitudinal direction of the magnet block. Therefore, a long magnet with a high strength can be provided.

Moreover, a plurality of the reinforcing members are provided and arranged discontinuously in the longitudinal direction of the magnet block. Therefore, a long magnet in which a high strength is supplied to parts that need reinforcement can be provided.

Furthermore, a plurality of the reinforcing members are provided and they are arranged inside of the magnet block in a layer structure. Therefore, the strength of the magnet block can be further enhanced.

Moreover, protrusions are formed on the reinforcing member and the protrusions intrude into the magnet block. Therefore, the reinforcing member is securely fixed to the magnet block, which allows joining to the magnet block without providing an adhesive layer.

Furthermore, the reinforcing member is made in a mesh form. Therefore, a long magnet excellent in magnetic characteristic and mechanical strength as well as good for productivity can be provided without impairing the characteristic of the magnet block.

Moreover, the reinforcing member is made of a film-like material. Therefore, a long magnet excellent in magnetic characteristic and mechanical strength as well as good for productivity can be provided without impairing the magnetic characteristic of the magnet block.

Furthermore, the contact face of the reinforcing member to the magnet block is made rough. Therefore, the contact area between the magnet block and the reinforcing member can be extended, thereby providing a long magnet good for adhesion.

Moreover, the ends of the reinforcing member of the longitudinal direction of the magnet block are made thicker than the middle portion of the reinforcing member. Therefore, edge effect of the magnet can be prevented, and a long magnet with stable magnetic characteristic in the longitudinal direction can be provided.

Furthermore, the ends of the longitudinal direction of the magnet block is made thinner than the middle portion. Therefore, the edge effect of the long magnet can be prevented compared with that of a long magnet of the same volume having a reinforcing member of a uniform thickness, and a long magnet with a stable magnetic characteristic in the longitudinal direction and good productivity can be provided.

Moreover, the reinforcing member and the mixture of rare earth magnetic powder, thermoplastic resin particles, fluidity additive, pigment, wax, and charge control agent are integrally compressed and molded in the mold. Therefore, it is possible to prevent breakage and chips of the magnet block from occurring in the production processes, and thus to obtain a long magnet good for productivity.

Furthermore, a groove extending in the axial direction is formed on the cylindrical plastic magnet and the long magnet according to any one of claims 1 to 19 is arranged in the groove and fixed. Therefore, a magnet roller excellent in magnetic characteristic, available at low cost and good for productivity can be provided when the long magnet excellent in mechanical strength and magnetic characteristic is used.

Moreover, a nonmagnetic sleeve is arranged on the outer periphery of the magnet roller of claim 21 and an electrostatic latent image formed on the image carrier by the image forming device which uses the developing roller with developing pole of the long magnet is developed. Therefore, an image forming device capable of forming images with high image quality can be provided.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A long magnet comprising:

a magnet block made of a mixture of rare earth magnetic powder, thermoplastic resin particles, fluidity additive, pigment, wax, and charge control agent; and a reinforcing member to reinforce the magnet block, at least part of the reinforcing member being arranged inside of the magnet block.

2. The long magnet according to claim 1, wherein the reinforcing member is made of metal.

3. The long magnet according to claim 1, wherein the reinforcing member is made of magnetic material.

4. The long magnet according to claim 1, wherein the reinforcing member is made of magnet material.

5. The long magnet according to claim 1, wherein the reinforcing member is made of flexible material.

6. The long magnet according to claim 5, wherein the flexible material contains magnetic powder.

7. The long magnet according to claim 6, wherein the magnetic powder is rare earth-type magnetic powder.

8. The long magnet according to claim 1, wherein the reinforcing member is composed of two or more materials.

9. The long magnet according to claim 1, wherein a flexural strength of the reinforcing member is higher than that of the magnet block.

10. The long magnet according to claim 1, wherein the reinforcing member has a same length as that of a longitudinal direction of the magnet block and is arranged to cover the whole length of the longitudinal direction of the magnet block.

11. The long magnet according to claim 1, wherein a plurality of the reinforcing members are provided and arranged discontinuously in a longitudinal direction of the magnet block.

12. The long magnet according to claim 1, wherein a plurality of the reinforcing members are provided and arranged inside of the magnet block in a layer structure.

13. The long magnet according to claim 1, wherein protrusions are formed on the reinforcing member and the protrusions intrude into the magnet block.

14. The long magnet according to claim 1, wherein the reinforcing member is formed in a mesh-like form.

15. The long magnet according to claim 1, wherein the reinforcing member is made of a film-like material.

16. A long magnet comprising:

a magnet block made of a mixture of rare earth magnetic powder, thermoplastic resin particles, fluidity additive, pigment, wax, and charge control agent; and a plurality of reinforcing members to reinforce the magnet block, at least one of the reinforcing members being arranged on one side of a longitudinal direction of the magnet block.

17. The long magnet according to claim 16, wherein the at least one of the reinforcing members is made of metal.

18. The long magnet according to claim 16, wherein the at least one of the reinforcing members is made of magnetic material.

19. The long magnet according to claim 16, wherein the at least one of the reinforcing members is made of magnet material.

20. The long magnet according to claim 16, wherein the at least one of the reinforcing members is made of flexible material.

21. The long magnet according to claim 20, wherein the flexible material contains magnetic powder.

22. The long magnet according to claim 21, wherein the magnetic powder is rare earth-type magnetic powder.

23. The long magnet according to claim 16, wherein the at least one of the reinforcing members is composed of two or more materials.

24. The long magnet according to claim 16, wherein a flexural strength of the at least one of the reinforcing members is higher than that of the magnet block.

25. The long magnet according to claim 16, wherein the at least one of the reinforcing members has a same length as that of the longitudinal direction of the magnet block and is arranged to cover the whole length of the longitudinal direction of the magnet block.

26. The long magnet according to claim 16, wherein the plurality of the reinforcing members are provided and arranged discontinuously in the longitudinal direction of the magnet block.

27. The long magnet according to claim 16, wherein the plurality of the reinforcing members are provided and arranged inside of the magnet block in a layer structure.

28. The long magnet according to claim 16, wherein protrusions are formed on the at least one of the reinforcing members and the protrusions intrude into the magnet block.

29. The long magnet according to claim 16, wherein the at least one of the reinforcing members is formed in a mesh-like form.

30. The long magnet according to claim 16, wherein the at least one of the reinforcing members is made of a film-like material.

31. The long magnet according to claim 16, wherein a surface of the at least one of the reinforcing members that makes a contact with the magnet block is rough.

32. The long magnet according to claim 16, wherein ends of the least one of the reinforcing members of the longitudinal direction of the magnet block are made thicker than a middle portion thereof.

33. The long magnet according to claim 16, wherein ends of the longitudinal direction of the magnet block are made thinner than a middle portion thereof.

34. A manufacturing method of a long magnet, comprising:

mixing of rare earth magnetic powder, thermoplastic resin particles, fluidity additive, pigment, wax and charge control agent into a mixture; and molding a reinforcing member integrally with the mixture in a mold by compression molding.

35. A magnet roller comprising:

a plastic magnet formed in a shape of a cylinder and having a groove that extends in a longitudinal direction of the plastic magnet; and a long magnet arranged and fixed to the groove, wherein the long magnet includes a magnet block made of a mixture of rare earth magnetic powder, thermoplastic resin particles, fluidity additive, pigment, wax, and charge control agent, and a reinforcing member to reinforce the magnet block, at least part of the reinforcing member being arranged inside of the magnet block.

36. A magnet roller comprising:

a plastic magnet formed in a shape of a cylinder and having a groove that extends in a longitudinal direction of the plastic magnet; and a long magnet arranged and fixed to the groove, wherein the long magnet includes a magnet block made of a mixture of rare earth magnetic powder, thermoplastic resin particles, fluidity additive, pigment, wax, and charge control agent, and a plurality of reinforcing members to reinforce the magnet block, at least one of the reinforcing members being arranged on one side of a longitudinal direction of the magnet block.

37. An image forming apparatus comprising:

a developing unit that includes a magnet roller including a plastic magnet formed in a shape of a cylinder and having a groove that extends in a longitudinal direction of the plastic magnet, and a long magnet arranged and fixed to the groove, wherein the long magnet includes a magnet block made of a mixture of rare earth magnetic powder, thermoplastic resin particles, fluidity additive, pigment, wax, and charge control agent, and a reinforcing member to reinforce the magnet block, at least part of the reinforcing member being arranged inside of the magnet block; and a nonmagnetic sleeve that is arranged on an outer periphery of the magnet roller.

38. An image forming apparatus comprising:

a developing unit that includes a magnet roller including a plastic magnet formed in a shape of a cylinder and having a groove that extends in a longitudinal direction of the plastic magnet, and a long magnet arranged and fixed to the groove, wherein the long magnet includes a magnet block made of a mixture of rare earth magnetic powder, thermoplastic resin particles, fluidity additive, pigment, wax, and charge control agent, and a plurality of reinforcing members to reinforce the magnet block, at least one of the reinforcing members being arranged on one side of a longitudinal direction of the magnet block; and a nonmagnetic sleeve that is arranged on an outer periphery of the magnet roller.

* * * * *